United States Patent [19]

McCready

[11] 4,098,043

[45] Jul. 4, 1978

[54] JOINT SEAL

[75] Inventor: Samuel D. McCready, Birmingham, Mich.

[73] Assignee: Harry S. Peterson Company, Pontiac, Mich.

[21] Appl. No.: 820,507

[22] Filed: Aug. 1, 1977

[51] Int. Cl.[2] ..... E01C 11/10; E04B 1/62

[52] U.S. Cl. ..... 52/403; 52/396; 404/47; 404/64; 404/65

[58] Field of Search ..... 52/396, 403, 573; 404/47, 64, 67, 69, 65

[56] References Cited

U.S. PATENT DOCUMENTS

| | | | |
|---|---|---|---|
| 3,394,640 | 7/1968 | Dreher | 52/396 X |
| 3,584,546 | 6/1971 | Bowman | 404/69 |
| 3,606,826 | 9/1971 | Bowman | 404/67 X |
| 3,653,305 | 4/1972 | Trieste | 404/64 |
| 3,788,758 | 1/1974 | Scheffel | 52/573 X |
| 3,918,824 | 11/1975 | Bowman | 404/65 X |

FOREIGN PATENT DOCUMENTS

| | | | |
|---|---|---|---|
| 974,110 | 9/1975 | Canada | 52/396 |
| 1,437,682 | 3/1966 | France | 404/64 |

*Primary Examiner*—Alfred C. Perham

*Attorney, Agent, or Firm*—Reising, Ethington, Barnard, Perry & Brooks

[57] ABSTRACT

A hollow elastomeric seal member having a bottom wall particularly formed to facilitate installation of the seal within an expansible joint.

9 Claims, 5 Drawing Figures

JOINT SEAL

The present invention relates to a new and improved elastomeric device for sealing the space between a pair of thermally expansible structural members which must initially be assembled in a nonabutting or non-contacting relationship. Such structural members are typified by reinforced concrete slabs used in the construction of roads, buildings or surface decks as in multistory parking structures. While such concrete slabs are rigid and high-load bearing members, they will expand and contract from less than an inch to several inches depending on changing ambient temperatures. Accordingly, it is normal practice to leave gaps or spaces between adjacent slabs and to fill such space with elastomeric members which are intended to seal the space between such slabs as the distance therebetween varies with temperature.

BACKGROUND

A variety of elastomeric seals have been developed to protect structural expansion joints against leakage as the joint opening varies with changes in ambient operating conditions. Such joint seals include numerous forms of peripheral and internal truss structures which cause the seal to function in a particular manner to seal a joint during the expansion and contraction of the associated structural members.

In addition to withstanding frequent flexure due to the expansion and contraction of the associated structural members, it is also frequently necessary for such joint seals to withstand transient deck loads imposed by vehicular or pedestrian traffic. Thus, it is necessary that such joint seals have sufficient strength and flexibility to elastically recover from both transverse movement and vertical flexure.

It is commonly required that such joint seals be compressible up to at least 50% of their uncompressed or free-state form without losing their ability to reexpand to their installed shape and size when such compressive forces are diminished.

SUBJECT INVENTION

It is the purpose of the present invention to provide an elastomeric joint seal which, while being able to withstand transverse movement and vertical flexure, also includes a unique construction which facilitates easy installation of the seal without depreciating its ability to recover or reexpand as such loads are lessened or relieved.

More specifically, the subject seal includes a pair of substantially parallel and planar side walls which are interconnected at their upper and lower ends by nonplanar and particularly formed upper and lower walls. It is also an object of the present invention to provide a uniquely formed bottom seal wall which permits relatively easy and limited initial transverse compression of the seal to facilitate its installation within a joint. The bottom wall of such seal is so formed that while having a relatively low initial resistance to transverse compression for easy of installation, the resistance to transverse compression increases perceptibly following installation of the seal in the joint.

The uniquely formed bottom seal wall also coacts through an internal truss structure to support the upper nonplanar wall so as to maintain an upper seal configuration which has a minimum vertical displacement or distortion relative to that which exists at the time of installation.

Other objects and advantages of the present invention will be apparent from the detailed description which follows.

Figure 1:
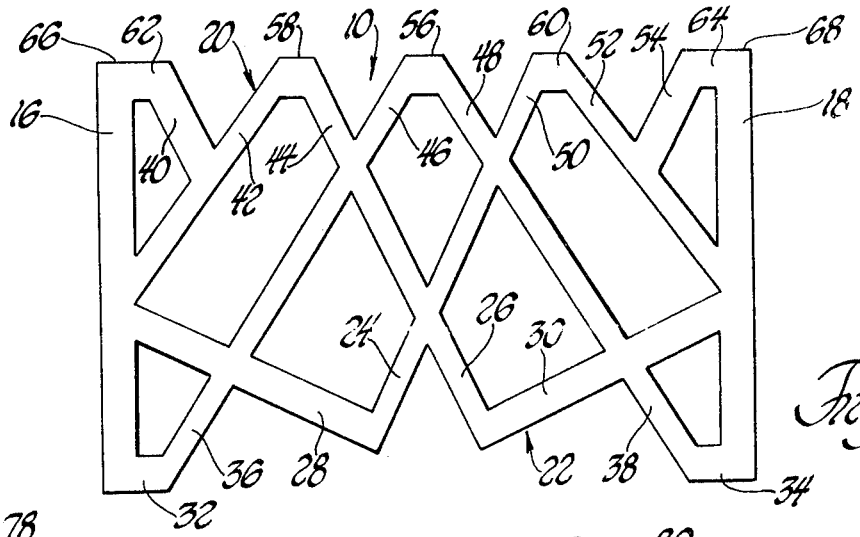
FIG. 1 is an elevational view of a first modification of the invention.
Figure 2:
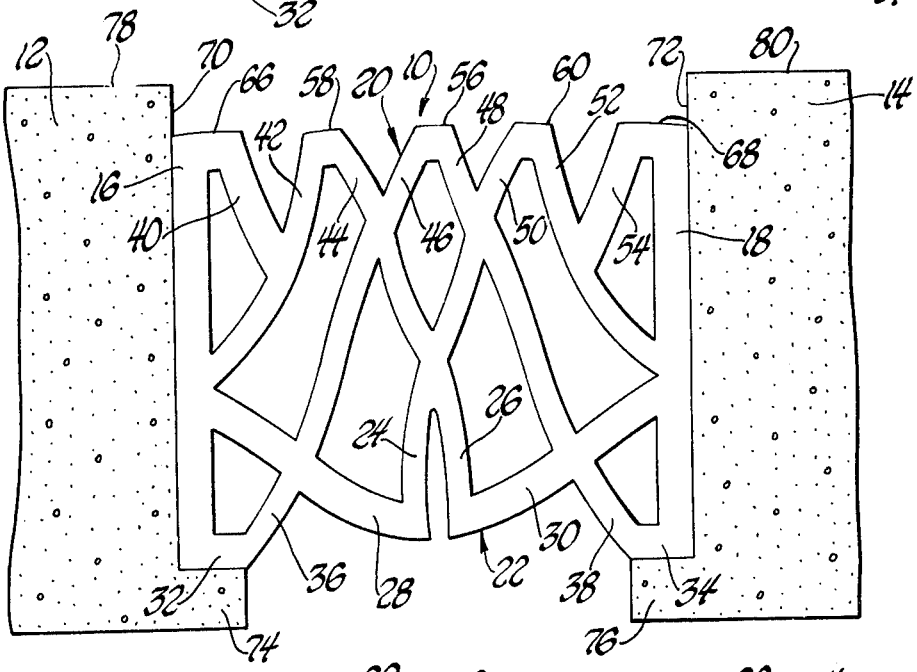
FIG. 2 is an elevational view of the seal as initially installed in the space between two structural members.
Figure 3:
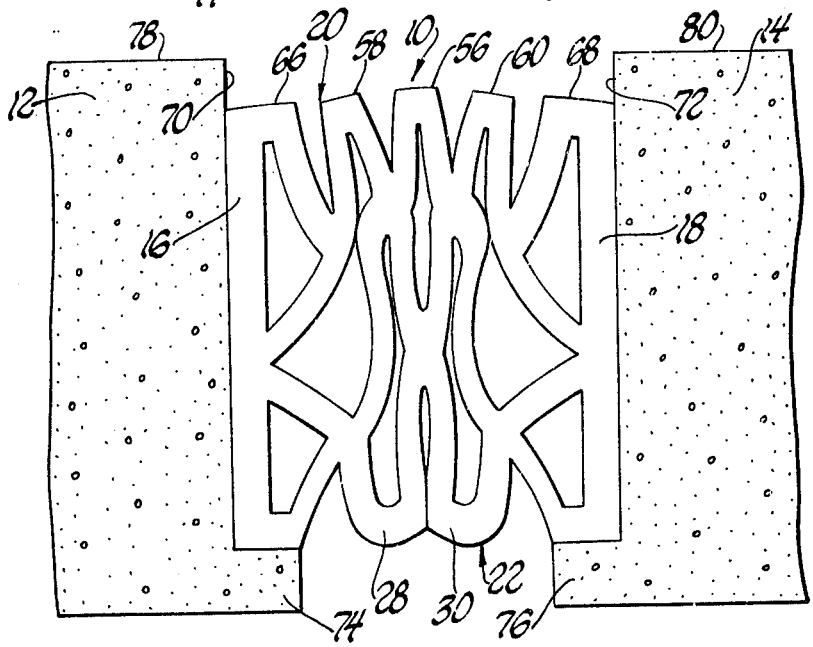
FIG. 3 is an elevational view illustrating the seal compressed to about 40% of its uncompressed or free-standing width.

FIGS. 1 through 3 relate to a first modification of the invention. The seal is indicated generally at 10 and the structural members defining the joint to be filled by the seal are indicated at 12 and 14. The most common use for seals of the type shown in the subject invention is in combination with structural members 12 and 14 formed of pre-stressed concrete as used in parking decks, sidewalks, building flooring and the like and where such seals or expansion joints are able to compensate for the lateral thermal expansion between the structural members while still maintaining the integrity or impermeability of such joints. It is basically required of such seals that they fill the joint between the structural members so as to accommodate thermally induced changes in the size of such joint while maintaining joint impermeability to water, dirt, and other debris throughout the thermal cycling of the joint.

Inasmuch as seal 10 is commonly used in installations subjected to either or both vehicle and pedestrian traffic, it is also imperative that the seal be of such a construction as not to bulge or be vertically distended at its top surface so as to provide an impediment to such traffic. In other words, even though seal 10 is designed to be transversely compressible to 50% or more of its free formed or uncompressed width, the upper and lower non-planar surfaces of the seal should not be significantly vertically distensible or deformable from its initially installed position.

It is also to be noted that the elastomeric seal of the present invention must be of the type as can be continuously extruded and cured so as to enable the joint seals to be cut to the exact length necessary to fill a particular joint and thereby avoiding the necessity of utilizing spliced or cemented joints in the field which are highly susceptible to breaking or being mis-matched after installation.

It is imperative in the design of the seal of the subject invention that it be formed in such a manner as to have sufficient internal resilience or strength as to insure that the seal can recover to its installed sealing condition as the seal is cycled from minimum to maximum compression over many years of use. In other words, while an elastomeric seal can be made which would be easy to install in a joint, the internal structure of the seal might be such as to have inadequate elastomeric or resilient recovery through the period of use required for such seal. It is thus a primary purpose of seals made in accordance with the subject invention to permit relatively easy initial installation of the seal within a joint and yet which seal is able to maintain the sealed integrity of the joint over the expected life of the seal. Referring specifically to FIG. 1 of the drawings, seal 10 is extruded of a suitable elastomeric material such as DuPont's Neoprene which is a thermosetting polymer generically known as polychloroprene mixed with carbon black, process oil, and other necessary rubber chemicals such as anti-oxidants, anti-ozonants and a curing agent. While the invention is in no way limited to a specific elastomer, the aforementioned material is one that has proven to be very satisfactory for seals of the type comprehended by the subject invention.

Seal 10 is of an enclosed or tubular construction and is adapted to be extruded in the form shown in FIG. 1 and which forming process includes extruding the seal in a "green" or uncured state followed as quickly as possible by a vulcanization of continuous curing process which gives the seal its final structural strength. Seal 10 includes a pair of planar and substantially parallel side walls 16 and 18, a nonplanar upper wall indicated generally at 20, and a nonplanar lower wall indicated generally at 22. The upper and lower walls 20 and 22 extend between the upper and lower ends of side walls 16 and 18. When using the expression "nonplanar", it is meant to refer to surfaces which are not flat and continuous as are side walls 16 and 18. In the modification of FIG. 1, it is also to be noted that the height of side walls 16 and 18 is less than the transverse distance between the side walls, which relationship also contributes to ease of initial installation. While the invention is not to be limited to specific dimensions, a typical seal of the type shown in FIG. 1 might have a width of 5 inches and a height of 3 inches.

Figure 4:
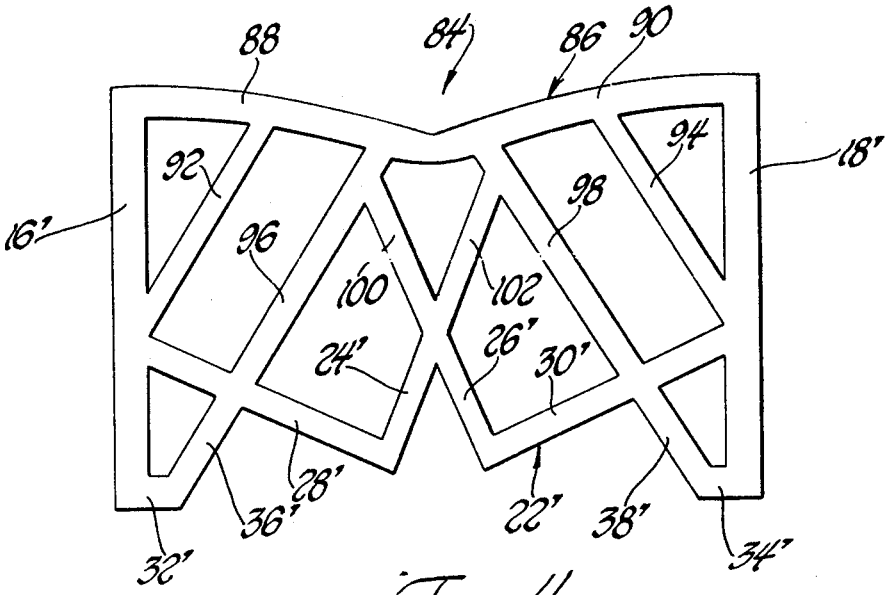
FIG. 4 is an elevational view of a second modification of the seal.

The configuration of bottom seal wall 22 is substantially identical in the modifications shown both in FIG. 1 and FIG. 4. Likewise, the side walls 16 and 18 are substantially identical in both modifications. On the other hand, the upper wall configuration 20 of FIG. 1 is different from that indicated generally at 86 in the seal 84 depicted in FIG. 4.

As will hereinafter be pointed out in greater detail, the nonplanar lower seal wall 22 is comprised of an interconnected series of linear sections symmetrically disposed about a vertical center line midway between side walls 16 and 18. Bottom wall 22 includes a first pair of linear sections 24 and 26 interconnected at their upper ends and transversely spaced at their lower ends so as to define a downwardly opening V. The apex of the downwardly opening V is generally coincident with the vertical mid-axis of the seal.

First and second linear compression bars 28 and 30 extend upwardly and outwardly from the spaced ends of linear sections 24 and 26 and respectively intersect with side walls 16 and 18 intermediate the upper and lower ends thereof. Visualizing a horizontal seal axis midway between the upper and lower ends of side walls 16 and 18, it is to be noted that the juncture of compression bars 28 and 30 is below such horizontal axis.

A pair of short linear bottom wall sections 32 and 34 extend horizontally from the lower ends of side walls 16 and 18 and terminate respectively between said side walls and the downwardly opening V of lower wall 22. A pair of linear wall legs 36 and 38 respectively extend upwardly from the inner ends of horizontal bottom wall sections 32 and 34 to intersect compression bars 28 and 30 intermediate the ends thereof. Thus, bottom seal wall 22 is comprised of linear sections 32, 36, 28, 24, 26, 30, 38, and 34.

Still referring to the modification of FIG. 1, upper seal wall 20 includes a plurality of angularly related linear sections 40, 42, 44, 46, 48, 50, 52, and 54. Linear sections 46 and 48 intersect in vertical alignment above the apex of the downwardly opening V of lower wall 22. The intersection of linear sections 46 and 48 is flattened at its top to provide a treadlike surface 56. Linear sections 46 and 48 extend downwardly and outwardly to intersect respectively at their lower ends with compression bars 28 and 30 at the same point of juncture therewith as upwardly extending sections or legs 36 and 38 of lower wall 22.

Similarly, upper wall sections 42–44 and 50–52 converge to form treadlike surfaces 58 and 60. Short linear sections 62 and 64 extend horizontally from the upper ends of side walls 16 and 18 and intersect respectively with downwardly and inwardly projecting wall sections 40 and 54 to form treadlike surfaces 66 and 68. Downwardly and inwardly extending upper wall sections 40 and 54 respectively terminate intermediate the ends of downwardly and outwardly extending linear sections 42 and 52, the latter which intersect with side walls 16 and 18 proximate the junction therewith of compression bars 28 and 30.

As best seen in FIG. 1, the treadlike sections 66, 58, 56, 60, and 68 of upper wall 20 are disposed in a generally coplanar relationship.

Referring now to FIG. 2 of the drawings, seal 10 is disposed in the opening defined by the laterally spaced structural members 12 and 14. Structural members 12 and 14 include oppositely facing planar surfaces 70 and 72 and inwardly extending projections 74 and 76 which provide surfaces upon which the horizontal sections 32 and 34 of lower seal wall 22 can seat within the joint opening. As thus seated within the joint opening formed between structural members 12 and 14, the treadlike surfaces of upper seal wall 20 are disposed slightly below the upper surfaces 78 and 80 of such structural members. Thus, the upper nonplanar wall 20 of seal 10 is adapted to be slightly recessed with respect to the upper exposed surfaces 78 and 80 of the structural members in order that the seal not project above the structural members and thereby avoiding an impediment to vehicular or pedestrian traffic.

In thus initially installing seal 10, as indicated in FIG. 2, the seal is transversely compressed approximately 15% of its free formed or uncompressed width as indicated in FIG. 1.

During the initial installation or 15% compression of seal 10, bottom seal wall 22 more or less articulates about the apex of its downwardly opening V and thus provides relatively low resistance to such initial compressive action. Accordingly, seal 10 can be manually transversely compressed to permit its insertion in the seal joint. During the initial insertion compression of seal 10, as depicted in FIG. 2, there is relatively little distortion of the upper and lower seal walls 20 and 22.

Figure 5:
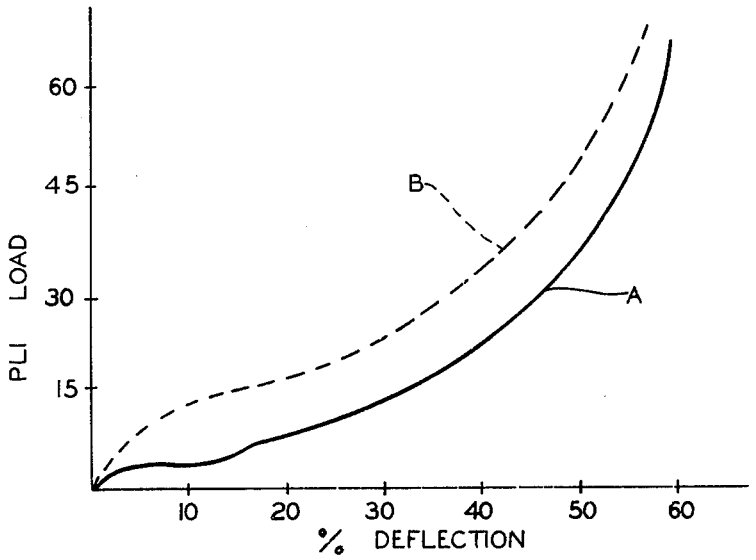
FIG. 5 is a load/deflection diagram of the seals of the types shown in FIGS. 1 and 4.

By reference now to the load deflection curve A shown in FIG. 5 which represents the compressive forces on seal 10 at different amounts of deflection, it will be noted that as the deflection of the seal progresses up to about 15%, the transverse loading of the seal expressed in pounds per linear inch remains low and relatively constant at approximately 5 pounds per inch. As the structural members 12 and 14 thermally expand from the initial installation position of FIG. 2 toward the positions indicated in FIG. 3, linear sections 24 and 26 of lower wall 22 reach an abutting position substantially closing the downwardly opening V and thereby bringing compression bars 28 and 30 into linear abutment with each other. This initial point of contact between the compression bars is depicted on the graph of FIG. 5 as occuring between the 15 and 20% deflection points and depicts a distinct increase in the transverse load on the seal. At such point of abutment between the compression bars 28 and 30, the compression load on the seal steps up from approximately 5 pounds per linear inch to approximately 10 pounds per linear inch.

With reference to FIG. 3, seal 10 is compressed to approximately 40% of its free formed or uncompressed shape as depicted in FIG. 1. Referring again to curve A of FIG. 5, it will be noted that at 40% deflection the compressive load on the seal has increased to approximately 15 pounds per linear inch. While the lower wall 22 of seal 10 undergoes substantial distortion when subjected to approximately 40% deflection, as illustrated in FIG. 3, it will be noted that upper wall 20 undergoes relatively little distortion other than the moving together of the threadlike surfaces which also tend to tilt slightly during severe seal compression. Further compression of seal 10 beyond the 40% deflection illustrated in FIG. 3 will not significantly alter the amount of distension of upper wall 20 and wherein the treadlike portions thereof do not depart appreciably from their original coplanar relationship and in no event do they project above the upper surfaces 78 and 80 of structural members 12 and 14. It is also to be noted that even with the severe seal compression of FIG. 3, upper and lower walls 20 and 22 do not distend meaningfully vertically beyond the upper and lower ends of side walls 16 and 18.

Reference is now made to the modification of FIG. 4 wherein the seal is generally indicated at 84. In this modification the lower wall and the linear sections of which it is comprised are the same as those shown and described with respect to FIGS. 1 through 3. Accordingly, prime marks have been added to the numerals of FIG. 1 to indicate like members. Thus, the description of the components bearing the primed numbers is the same as that made with respect to FIGS. 1–3.

The primary difference between seals 10 and 84 relates to the shape or configuration of their upper walls. In the case of FIG. 4, upper wall 86 is comprised of two inwardly and downwardly curved sections 88 and 90 which converge at a centrally depressed juncture vertically spaced above the apex defined by intersecting sections 24′ and 26′ of lower wall 22′.

The internal truss structure of seal 84 includes a first pair of downwardly and outwardly extending cross bars 92 and 94 which respectively intersect upper wall sections 88 and 90 at their upper ends and terminate at their lower ends with side walls 16′ and 18′ immediately above the juncture therewith of compression bars 28′ and 30′. A second pair of downwardly and outwardly extending cross bars 96 and 98 extend between the centrally depressed region of upper wall 86 and compression bars 28′ and 30′ opposite the junction therewith by upwardly extending bottom wall sections 36′ and 38′. A third pair of cross bars 100 and 102 converge at their lower ends with the apex of the downwardly opening V formed by lower wall sections 24′ and 26′. The upper ends of cross bars 100 and 102 intersect respectively with cross bars 96 and 98 proximate upper wall 86.

The configuration of lower wall 22′ of seal 84 from initial insertion of the seal in a joint through the seal's compression is substantially identical with that of seal 10 as depicted in FIGS. 2 and 3 of the drawings.

On the other hand, as seal 84 is transversely compressed, the depressed central juncture between upper wall sections 88 and 90 moves progressively downwardly whereby the downward curvature of sections 88 and 90 increases. As transverse compression of seal 84 increases, thereby depressing the central section of upper wall 86, wall sections 88 and 90 move into progressively increasing rolling abutment with each other. Such downwardly rolling abutment of upper wall sections 88 and 90 assures that upper seal wall 86 will not project above the seal joint as the seal 84 is transversely compressed.

Reference is now made to curve B of FIG. 5 which depicts the load/deflection relationship of seal 84. In this case it will be noted that the downwardly curving upper wall 86, in effect, stiffens the seal or increases its resistance to transverse compression. For instance, at a 15% deflection, the compression load is approximately 15 pounds per linear inch with the result that seal 84 would require more force for initial installation as compared with that required for seal 10. However, it is also to be noted from curve B that beginning at about 15% deflection, the upward slope of curve B increases again, reflecting the initial linear abutment of compression bars 28′ and 30′. As with both seals 10 and 84, the provision of the centrally disposed, downwardly opening central V section reduces the transverse force necessary for initial installation of the seal in the joint between adjacently disposed structural members such as 12 and 14.

It is to be understood that the buildup in compressive forces, as depicted by curves A and B of FIG. 5, allows the seals 10 and 84 to recover or reexpand as the joint opens.

In order to further enhance the impermeability of the sealed joints, particularly to the passage of water, it is preferred to utilize a urethane of neoprene based adhesive between the seal and the structural members. More particularly, such adhesive is applied to planar side walls 70 and 72 of the structural members 12 and 14. Prior to curing, the adhesive also performs a lubricating function to facilitate insertion of the seal within the joint formed by structural members 12 and 14. After insertion, the adhesive will cure thereby bonding the planar side walls 16 and 18 to the planar surfaces 70 and 72 of structural members 12 and 14. It will be appreciated that the greater the ability of the elastomeric seal to return to a more expanded condition as thermal conditions cause the joint to open, the less will be the tendency of the adhesive bond between the seal and structural members to break down in use.

In the modifications of both FIGS. 1 and 2 the width of the open end of the downwardly opening V is approximately 15% of the total uncompressed width of the seal. Depending on the seal size, the V opening may be up to 30% of the uncompressed width of the seal.

It is apparent that various modifications of seals may be made within the intended scope of the invention as set forth in the hereinafter appended claims.

What is claimed is:

1. A joint seal comprising an elastomeric tubular structure having a pair of laterally spaced planar side walls, a nonplanar upper wall interconnecting the upper ends of said side walls, and a nonplanar lower wall interconnecting the lower ends of said side walls, said lower wall including a first pair of angularly related linear wall sections interconnected at one pair of ends and laterally spaced at the other ends to define a downwardly opening V centrally of said side walls, first and second linear compression bars respectively connecting the spaced other ends of the angularly related wall sections with said side walls at points below the vertical midpoints of said side walls, said lower wall including a second pair of linear sections respectively projecting from proximate the lower ends of said side walls to points intermediate the ends of the first and second compression bars, said first pair of angularly related wall sections moving into abutting relationship after initial lateral compression of said seal.

2. A joint seal as set forth in claim 1 wherein said first pair of angularly related wall sections are moved into abutting relationship when the seal is laterally compressed by approximately 15% from its uncompressed state whereby said compression bars will resiliently resist further lateral seal compression.

3. A joint seal as set forth in claim 1 wherein the distance between the spaced ends of said first pair of angularly related wall sections does not exceed 30% of the distance between said side walls when the seal is uncompressed.

4. A joint seal comprising an elastomeric tubular structure having a pair of laterally spaced planar side walls, a nonplanar upper wall interconnecting the upper ends of said side walls, said upper wall comprising a plurality of angularly related and interconnected linear wall sections which terminate at their upper ends in tread-like surfaces all of which are disposed in coplanar relationship with the upper ends of said side walls, and a nonplanar lower wall interconnecting the lower ends of said side walls, said lower wall including a first pair of angularly related linear wall sections interconnected at one pair of ends and laterally spaced at the other ends to define a downwardly opening V centrally of said side walls, first and second linear compression bars respectively connecting the spaced other ends of the angularly related wall sections with said side walls at points below the vertical midpoints of said side walls, said lower wall including a second pair of linear sections respectively projecting from proximate the lower ends of said side walls to points intermediate the ends of the first and second compression bars, said first pair of angularly related wall sections moving into abutting relationship after limited initial lateral compression of said seal.

5. A joint seal as set forth in claim 4 wherein at least two of the angularly related linear wall sections of said upper wall respectively terminate at their lower ends at the junctions of said first and second compression bars with said side walls.

6. A joint seal as set forth in claim 5 wherein two angularly related wall sections of said upper wall respectively extend from proximate the upper ends of said side walls to points intermediate the ends of the two upper wall sections which terminate at one end at the junctions of said compression bars with said side walls.

7. A joint seal comprising an elastomeric tubular structure having a pair of laterally spaced planar side walls, a nonplanar upper wall interconnecting the upper ends of said side walls, said upper wall including a pair of downwardly curving arcuate wall sections terminating in a common juncture centrally of said planar side walls, and a nonplanar lower wall interconnecting the lower ends of said side walls, said lower wall including a first pair of angularly related linear wall sections interconnected at one pair of ends and laterally spaced at the other ends to define a downwardly opening V centrally of said side walls, first and second linear compression bars respectively connecting the spaced other ends of the angularly related wall sections with said side walls at points below the vertical midpoints of said side walls, said lower wall including a second pair of linear sections respectively projecting from proximate the lower ends of said side walls to points intermediate the ends of the first and second compression bars, and an internal truss structure disposed within the volume defined by the upper and lower nonplanar walls and the planar side walls, said truss structure including a pair of web members respectively extending between said downwardly curving upper wall sections and the juncture of said compression bars with said side walls, said first pair of angularly related wall sections moving into abutting relationship after limited initial lateral compression of said seal.

8. A joint seal as set forth in claim 7 wherein said internal truss structure includes a second pair of web members respectively extending between the downwardly sloping sections of the upper wall and the first and second compression bars.

9. A joint seal as set forth in claim 8 wherein said internal truss structure includes a third pair of web members extending respectively between the second pair of web members and the apex of the downwardly opening V of said lower wall.

* * * * *